US011196194B2

(12) United States Patent
Jin

(10) Patent No.: US 11,196,194 B2
(45) Date of Patent: Dec. 7, 2021

(54) ELECTRICAL CONNECTOR

(71) Applicant: LOTES CO., LTD, Keelung (TW)

(72) Inventor: Zuo Feng Jin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/934,420

(22) Filed: Jul. 21, 2020

(65) Prior Publication Data

US 2021/0044038 A1 Feb. 11, 2021

(30) Foreign Application Priority Data

Aug. 7, 2019 (CN) ..... 201921275480.7

(51) Int. Cl.
*H01R 12/58* (2011.01)

(52) U.S. Cl.
CPC ..... *H01R 12/58* (2013.01)

(58) Field of Classification Search
CPC .. H01R 13/514; H01R 12/714; H01R 12/716; H01R 12/75; H01R 13/02; H01R 13/6582; H01R 12/52; H01R 12/57; H01R 12/585; H01R 12/707; H01R 12/73; H01R 13/08; H01R 13/2442; H01R 13/405; H01R 13/41; H01R 13/506; H01R 13/518; H01R 13/6474; H01R 13/6581; H01R 13/6658; H01R 2107/00; H01R 24/64; H01R 4/02; H01R 12/00; H01R 12/523; H01R 12/53; H01R 12/55; H01R 12/592; H01R 12/65; H01R 12/69; H01R 12/7076; H01R 12/712; H01R 12/718; H01R 12/721;
(Continued)

(56) References Cited

U.S. PATENT DOCUMENTS 3,862,792 A * 1/1975 Jayne ..... H01R 13/111 439/733.1
4,639,056 A * 1/1987 Lindeman ..... H01R 13/405 439/61

(Continued)

FOREIGN PATENT DOCUMENTS

CN 204088669 U 1/2015
CN 205212010 U 5/2016

*Primary Examiner* — Truc T Nguyen
(74) *Attorney, Agent, or Firm* — Locke Lord LLP; Tim Tingkang Xia, Esq.

(57) ABSTRACT

An electrical connector includes: a circuit board, provided with multiple accommodating holes, where each accommodating hole is circular shaped; multiple terminals, where each terminal includes a base, and the base is accommodated in a corresponding accommodating hole; and multiple strip connecting portions, configured to be connected to a corresponding one of the first strips. One strip connecting portion and the corresponding base are fixed to each other. When the strip connecting portion and the corresponding base are inserted into the corresponding accommodating hole, the strip connecting portion supports and abuts the corresponding base, such that the corresponding terminal is not easily deformed or rotated during the insertion, and the corresponding terminal is not easily damaged. The strip connecting portion, the corresponding base and the corresponding accommodating hole form a contact of at least three points, ensuring the corresponding terminal to be stably fixed in the corresponding accommodating hole.

9 Claims, 17 Drawing Sheets

(58) Field of Classification Search
CPC .. H01R 12/724; H01R 12/737; H01R 12/774; H01R 12/79; H01R 13/025; H01R 13/03; H01R 13/05; H01R 13/10; H01R 13/15; H01R 13/20; H01R 13/22; H01R 13/24; H01R 13/2407; H01R 13/2428; H01R 13/2435; H01R 13/2464; H01R 13/2492; H01R 13/33; H01R 13/40; H01R 13/426; H01R 13/44; H01R 13/502; H01R 13/5025; H01R 13/6205; H01R 13/6272; H01R 13/6275; H01R 13/6277; H01R 13/633; H01R 13/635; H01R 13/64; H01R 13/641; H01R 13/6461; H01R 13/6463; H01R 13/6467; H01R 13/6469; H01R 13/6471; H01R 13/6473; H01R 13/6476; H01R 13/6587; H01R 13/6591; H01R 13/6592; H01R 13/6593; H01R 13/6594; H01R 13/6598; H01R 13/66; H01R 13/6625; H01R 13/6666; H01R 13/6683; H01R 13/6691; H01R 13/703; H01R 13/713; H01R 13/717; H01R 13/7195; H01R 13/73; H01R 2103/00; H01R 2105/00; H01R 2201/02; H01R 2201/12; H01R 2201/26; H01R 24/58; H01R 24/76; H01R 25/006; H01R 25/14; H01R 25/142; H01R 25/145; H01R 25/147; H01R 25/162; H01R 31/005; H01R 31/06; H01R 31/065; H01R 33/18; H01R 33/74; H01R 33/88; H01R 43/01; H01R 43/205; H01R 43/24; H01R 4/2404; H01R 4/2416; H01R 4/58; H01R 9/2466; H01R 9/2491; H01R 9/26
See application file for complete search history.

(56) References Cited

U.S. PATENT DOCUMENTS

| | | | | | |
|---|---|---|---|---|---|
| 4,684,203 | A * | 8/1987 | Bihler | H01R 12/585 29/876 |
| 4,857,018 | A * | 8/1989 | Pickles | H01R 12/585 439/751 |
| 5,374,204 | A * | 12/1994 | Foley | H01R 13/114 439/751 |
| 6,139,373 | A * | 10/2000 | Ward | H01R 12/00 439/733.1 |
| 10,116,079 | B1 | 10/2018 | Ju et al. | |
| 2005/0042935 | A1* | 2/2005 | Larsen | H01R 12/58 439/751 |
| 2019/0267737 | A1* | 8/2019 | Venaleck | H01R 13/112 |
| 2019/0280415 | A1* | 9/2019 | Huang | H01R 13/2464 |
| 2019/0326697 | A1* | 10/2019 | Ho | H01R 12/707 |

* cited by examiner

A-A

100

100

100

100

100

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201921275480.7 filed in China on Aug. 7, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector electrically connecting a chip module to a mainboard.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In an existing electrical connector electrically connecting a chip module to a mainboard, a body has multiple accommodating holes running therethrough vertically, and multiple terminals are correspondingly accommodated in the accommodating holes. Each of the terminals includes a base and an elastic arm. The base is accommodated in the corresponding accommodating hole, and the elastic arm upward abuts the chip module. However, to improve the fatigue resistance, the terminals are formed by stamping a thin plate. Consequently, the base of each terminal is not easily inserted into the corresponding accommodating hole, and additionally, when inserted into the corresponding accommodating hole, the base is easily deformed and dislocated. When the chip module downward abuts the elastic arm, the terminals are easily distorted and deformed.

Therefore, a heretofore unaddressed need to design an improved electrical connector exists in the art to address the aforementioned deficiencies and inadequacies.

SUMMARY

The present invention is directed to an electrical connector, which fixes the terminals in a circuit board by fixing a strip connecting portion and a base, such that the terminals are fatigue-resistant, not easily deformed, and stable in contact.

To achieve the foregoing objective, the present invention adopts the following technical solutions.

An electrical connector includes: a circuit board, provided with a plurality of accommodating holes, wherein each of the accommodating holes is circular shaped; a plurality of terminals, wherein each of the terminals comprises a base, and the base is accommodated in a corresponding one of the accommodating holes; and a plurality of strip connecting portions, configured to be connected to a corresponding one of the first strips, wherein one of the strip connecting portions and the base of a corresponding one of the terminals are fixed to each other and are accommodated in the corresponding one of the accommodating holes, and the one of the strip connecting portions, the base of the corresponding one of the terminals and the corresponding one of the accommodating holes altogether form a contact of at least three points.

In certain embodiments, a virtual central line of the one of the strip connecting portions in a width direction and a virtual central line of the corresponding one of the accommodating holes are coincident, and the one of the strip connecting portions and the corresponding one of the accommodating holes form the contact of at least three points.

In certain embodiments, a width of each of the strip connecting portions is greater than a width of the base of each of the terminals, and a thickness of each of the strip connecting portions is greater than a thickness of the base of each of the terminals.

In certain embodiments, each of the strip connecting portions is configured to be connected upward to the corresponding one of the first strips, wherein each of the first strips comprises a plurality of first pre-breaking portions correspondingly connected to the strip connecting portions, the base is configured to be connected downward to a second strip, the second strip comprises a plurality of second pre-breaking portions correspondingly connected to the base of each of the terminals, and the first strips and the second strips are provided in parallel vertically, each of the first pre-breaking portions is correspondingly located higher than the base, and each of the second pre-breaking portions is correspondingly located lower than one of the strip connecting portions.

In certain embodiments, the terminals comprise a plurality of low frequency signal terminals, the accommodating holes comprise a plurality of first accommodating holes correspondingly accommodating the low frequency signal terminals, an inner wall of each of the first accommodating holes is provided with a conductive layer, and the conductive layer is electrically connected to a corresponding one of the low frequency signal terminals.

In certain embodiments, the terminals further comprise a plurality of high frequency signal terminals, the accommodating holes further comprise a plurality of second accommodating holes correspondingly accommodating the high frequency signal terminals, and an inner wall of each of the second accommodating holes is not provided with the conductive layer; and the terminals further comprise a plurality of ground terminals and a plurality of power terminals, the accommodating holes further comprise a plurality of third accommodating holes correspondingly accommodating the ground terminals and the power terminals, an inner wall of each of the third accommodating holes is provided with a conductive layer, and the conductive layer of each of the third accommodating holes is electrically connected to a corresponding one of the ground terminals and a corresponding one of the power terminals.

In certain embodiments, a virtual central line of the base in a width direction and a virtual central line of the corresponding one of the accommodating holes are coincident, and the base and the corresponding one of the accommodating holes form the contact of at least three points.

In certain embodiments, the one of the strip connecting portions and the corresponding one of the accommodating holes form a contact of two points, and the base and the corresponding one of the accommodating holes form a contact of at least one point; or the one of the strip connecting portions and the corresponding one of the accommodating holes form a contact of one point, and the base and the corresponding one of the accommodating holes form a contact of at least two points.

In certain embodiments, the one of the strip connecting portions, the base of the corresponding one of the terminals and the corresponding one of the accommodating holes altogether form a contact of four points, the one of the strip connecting portions and the corresponding one of the accommodating holes form a contact of two points, the base and the corresponding one of the accommodating holes form a contact of two points, and a virtual central line of the base of the corresponding one of the terminals in a width direction and a virtual central line in a width direction of the one of the strip connecting portions are coincident.

In certain embodiments, each of the strip connecting portions comprises a first corner point and a second corner point, the first corner point and the second corner point both abut the corresponding one of the accommodating holes, the base comprises a third corner point and a fourth corner point, the third corner point and the fourth corner point both abut the corresponding one of the accommodating holes, and a distance between the first corner point and the second corner point is greater than a distance between the third corner point and the fourth corner point.

Compared with the related art, the electrical connector according to certain embodiments of the present invention has the following beneficial effects:

The strip connecting portions and the terminals of the electrical connector are correspondingly fixed to each other and are inserted into the corresponding accommodating holes. Each strip connecting portion, the base of the corresponding terminal and the corresponding accommodating hole altogether form a contact of at least three points. When each strip connecting portion and the corresponding base are inserted into the corresponding accommodating hole, the strip connecting portion supports and abuts the corresponding base, such that the corresponding terminal is not easily deformed or rotated during the insertion, and the corresponding terminal is not easily damaged, ensuring the corresponding terminal to be stably fixed in the corresponding accommodating hole. When the chip module presses downward, a stable contact may be achieved between each terminal and the chip module. In addition, a thickness of each terminal remains unchanged when the foregoing performance is ensured, such that the terminals are provided with fatigue-resistant.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
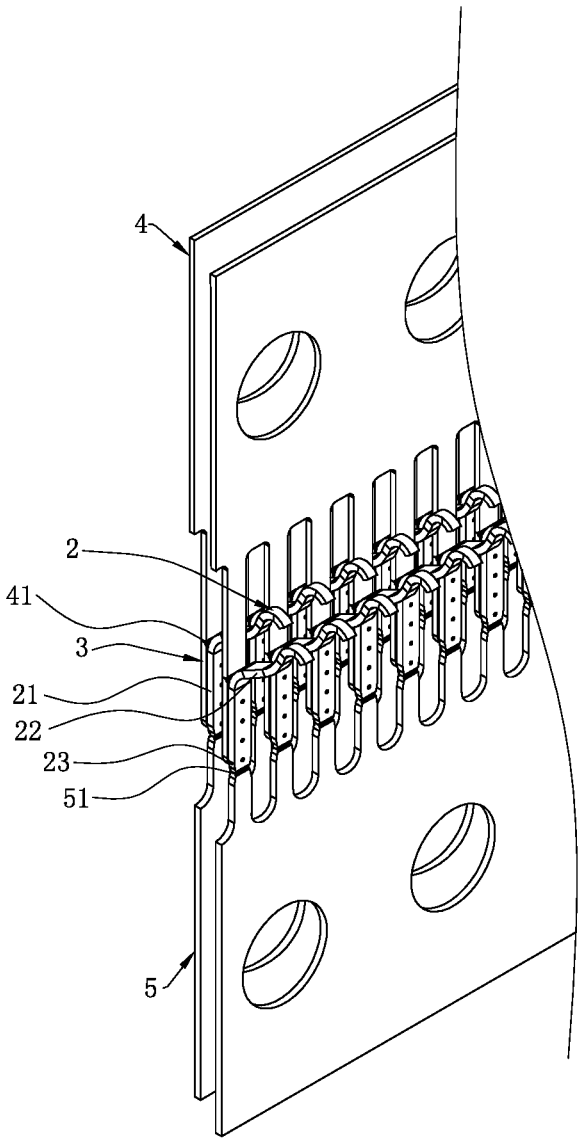
FIG. 1 is a partial schematic view of the strip connecting portions correspondingly connected to the first strips, and the terminals correspondingly connected to the second strips according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-13. In accordance with the purposes of this invention, as embodied and broadly described herein, this invention, in one aspect, relates to an electrical connector.

FIG. 1 to FIG. 7 show an electrical connector 100 according to a first embodiment of the present invention. The electrical connector 100 relates to a land grid array (LGA) connector configured to electrically connect a chip module (not shown, similarly as follows) to a mainboard (not shown, similarly as follows). The electrical connector 100 includes a circuit board 1, and a plurality of terminals 2 and a plurality of strip connecting portions 3 accommodated in the circuit board 1. An upper end of each of the terminals 2 elastically abuts the chip module, and a lower end of each of the terminals 2 is soldered to the mainboard through a solder. Each of the strip connecting portions 3 is fixed to a corresponding terminal 2.

As shown in FIG. 3 to FIG. 6, the circuit board 1 includes a plurality of accommodating holes 11 running through an upper surface and a lower surface thereof. The accommodating holes 11 are circular shaped, such that the terminals 2 may be inserted into the accommodating holes 11 better. Compared with an insulating body made of a plastic material in general, the circuit board 1 is provided with a better shielding performance, which may effectively shield the noise and crosstalk interferences between two adjacent terminals 2, and costs are relatively low, which is conducive to industrial production. The accommodating holes 11 are arranged alternately in front and back rows, and two adjacent accommodating holes 11 in a front row are symmetrical about a accommodating hole 11 in a back row. The accommodating holes 11 correspondingly accommodate the terminals 2 of different types. The accommodating holes 11 include a plurality of first accommodating holes 111, a plurality of second accommodating holes 112 and a plurality of third accommodating holes 113. Each of an inner wall of each of the first accommodating holes 111 and an inner wall of each of the third accommodating holes 113 is provided with a conductive layer 12, and an inner wall of each of the second accommodating holes 112 is not provided with the conductive layer 12.

Figure 2:
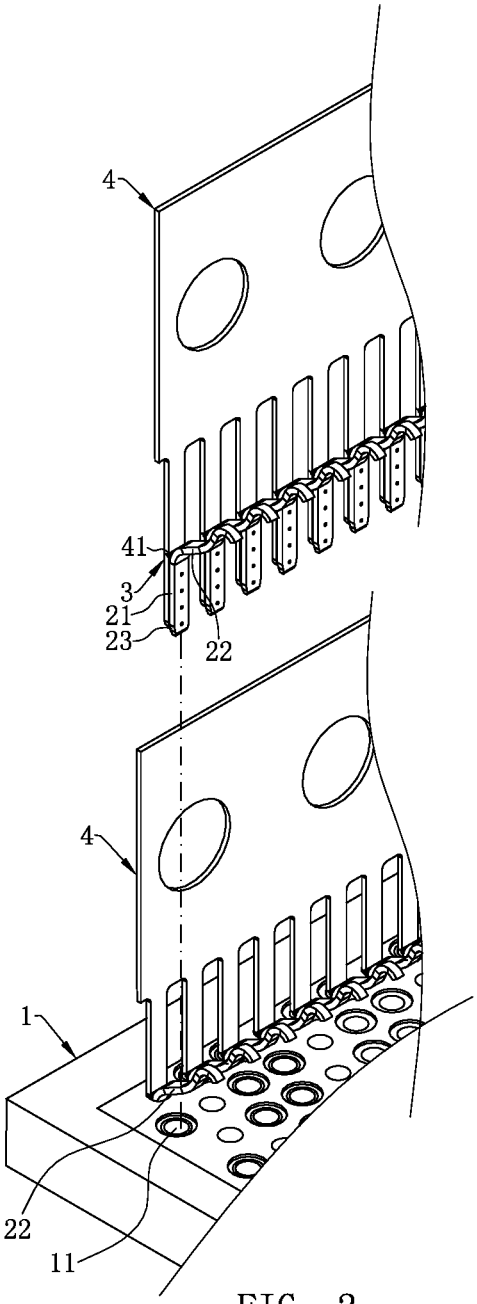
FIG. 2 is a partial schematic view of the first strips, the strip connecting portions and the terminals being correspondingly inserted into the accommodating holes in FIG. 1.
Figure 3:
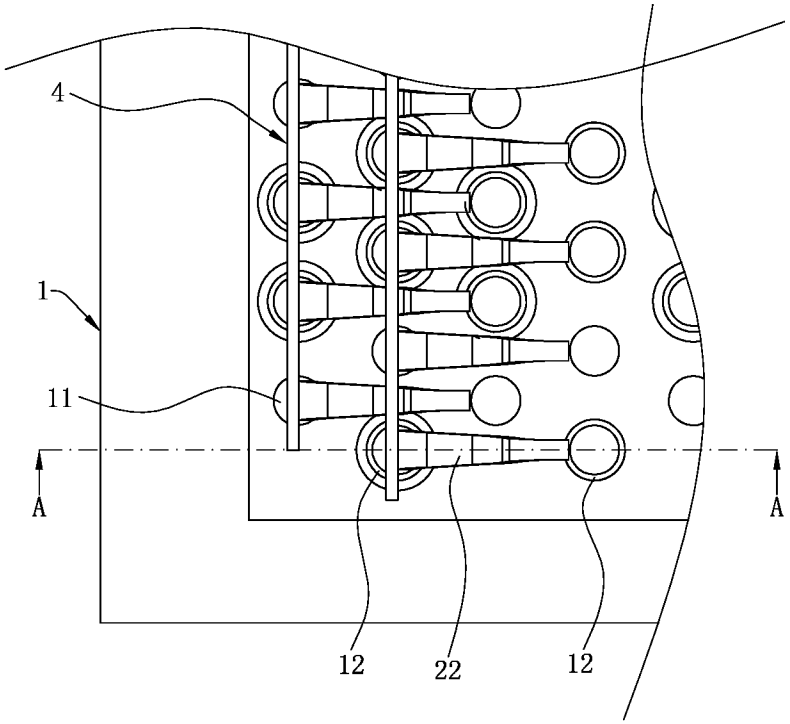
FIG. 3 is a top assembled view of FIG. 2.
Figure 4:
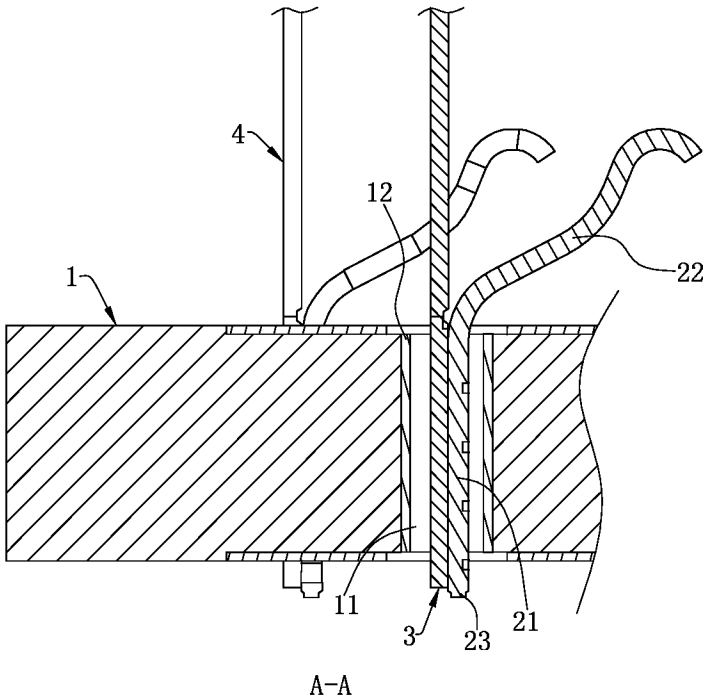
FIG. 4 is a partial sectional view taken along a line A-A in FIG. 3.
Figure 5:
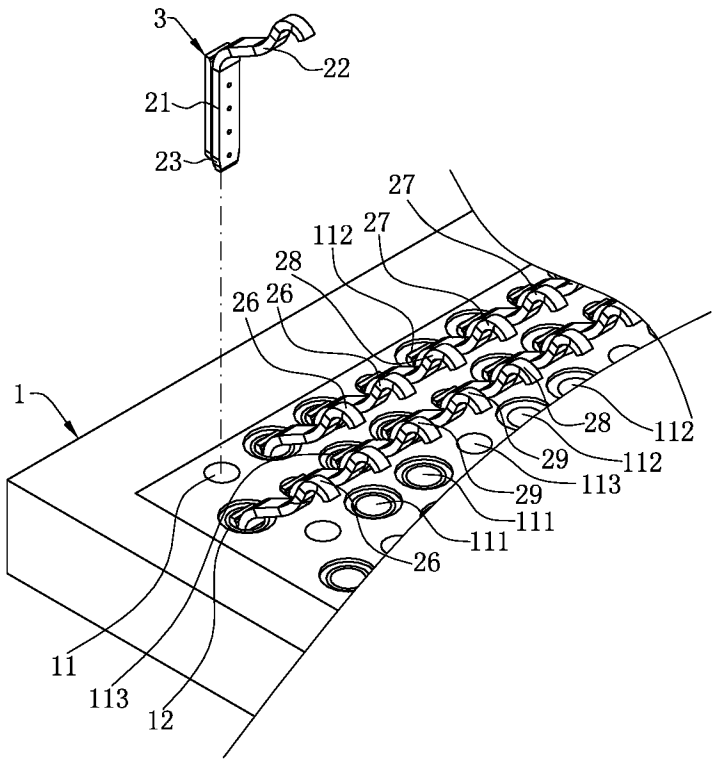
FIG. 5 is a partial exploded schematic view of an electrical connector according to the first embodiment of the present invention.
Figure 6:
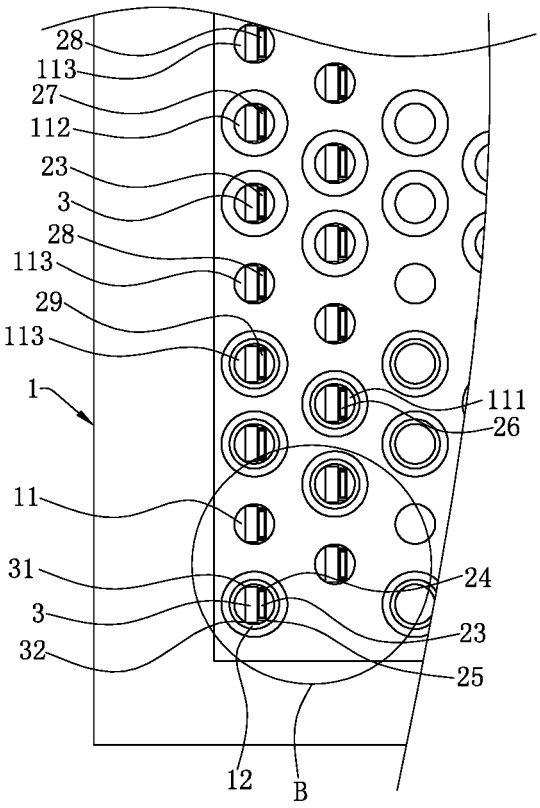
FIG. 6 is a partial top view of the electrical connector according to the first embodiment of the present invention.

As shown in FIG. 2, FIG. 4 and FIG. 6, each of the terminals 2 includes a base 21, and an elastic arm 22 and a soldering portion 23 formed by extending from two ends of the base 21. The base 21 is accommodated in the corresponding accommodating hole 11. The elastic arm 22 is exposed on the upper surface of the circuit board 1 and upward abuts the chip module, and the soldering portion 23 is exposed on the lower surface of the circuit board 1 and is soldered downward to the mainboard. The terminals 2 include a plurality of low frequency signal terminals 26, a plurality of high frequency signal terminals 27, a plurality of ground terminals 28 and a plurality of power terminals 29. The first accommodating holes 111 correspondingly accommodate the low frequency signal terminals 26. The inner wall of each of the first accommodating holes 111 is provided with the conductive layer 12, and each of the low frequency signal terminals 26 is electrically connected to the conductive layer 12 of the corresponding first accommodating hole 111, thus enlarging a grounding path and effectively shielding the noise and crosstalk interferences between two low frequency signal terminals 26. The second accommodating holes 112 correspondingly accommodate the high frequency signal terminals 27. Each of the high frequency signal terminals 27 has a relatively high requirement on signal transmission, and an impedance in a transmission path thereof should be relatively small. Therefore, there is no conductive layer 12 on the inner wall of each of the second accommodating holes 112. The third accommodating holes 113 correspondingly accommodate the ground terminals 28 and the power terminals 29. The inner wall of each of the third accommodating holes 113 is provided with the conductive layer 12, and each of the ground terminals 28 and the power terminals 29 is electrically connected to the conductive layer 12 of the corresponding third accommodating hole 113, thus enlarging a grounding path and effectively shielding the noise and crosstalk interferences between two ground terminals 28 or two power terminals 29.

Figure 7:
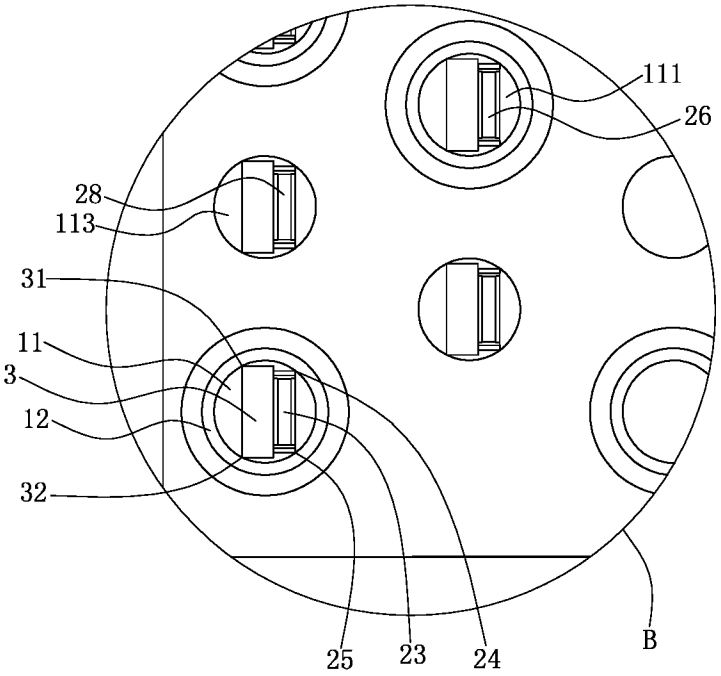
FIG. 7 is an enlarged view of a part B in FIG. 6.

As shown in FIG. 1, FIG. 6 and FIG. 7, each of the strip connecting portions 3 is correspondingly fixed to the base 21 of the corresponding terminal 2, and the fixing method may be soldering, welding, clamping, or the like. A plate surface of each of the strip connecting portions 3 is in contact with a plate surface of the base 21 of the corresponding terminal 2, thus increasing a contact area therebetween and stabilizing the fixing. One of the strip connecting portions 3 and a corresponding one of the bases 21 are accommodated in a corresponding accommodating hole 11, and the strip connecting portion 3, the base 21 of the corresponding terminal 2 and the corresponding accommodating hole 11 form a contact of four points. The strip connecting portion 3 and the corresponding accommodating hole 11 form a contact of two points, and the base 21 and the corresponding accommodating hole 11 form another contact of two points. A virtual central line of the base 21 in a width direction and a virtual central line of the strip connecting portion 3 in a width direction are coincident, and the strip connecting portion 3 and the base 21 are symmetrical about a virtual central line of the corresponding accommodating hole 11 in the width direction. The abutting forces between the strip connecting portion 3 as well as the base 21 and the corresponding accommodating hole 11 are balanced with each other, and a structure between the strip connecting portion 3 and the base 21 is stable. A width of the strip connecting portion 3 is greater than a width of the base 21, and a thickness of the strip connecting portion 3 is greater than a thickness of the base 21. A rigidity of the strip connecting portion 3 is large, and a volume occupied by the strip connecting portion 3 in the corresponding accommodating hole 11 is large. Thus, the strip connecting portion 3 may fully support the base 21, such that the base 21 may not be deformed, rotated or the like, and the corresponding terminal 2 is not easily damaged. Each of the strip connecting portions 3 includes a first corner point 31 and a second corner point 32. The first corner point 31 and the second corner point 32 both abut the corresponding accommodating hole 11. The base 21 includes a third corner point 24 and a fourth corner point 25. The third corner point 24 and the fourth corner point 25 both abut the corresponding accommodating hole 11. The width of the strip connecting portion 3 is greater than the width of the base 21. Thus, a distance between the first corner point 31 and the second corner point 32 is greater than a distance between the third corner point 24 and the fourth corner point 25, and an area of the plate surface of the strip connecting portion 3 is greater than a contact area between the strip connecting portion 3 and the base 21. That is, the plate surface of the base 21 is completely covered by the strip connecting portion 3, such that the strip connecting portion 3 may abut the entire base 21, and the structure is more stable.

As shown in FIG. 1 to FIG. 5, the strip connecting portions 3 are configured to be connected upward to a corresponding one of the first strips 4. The first strips 4 include a plurality of first pre-breaking portions 41 correspondingly connected to the strip connecting portions 3. A thickness of each of the first pre-breaking portions 41 is less than the thickness of each of the strip connecting portions 3. The first pre-breaking portions 41 are configured to bend and remove the first strip 4. The base 21 is configured to be connected downward to the soldering portion 23. The soldering portion 23 is configured to be connected downward to a corresponding one of the second strips 5. The second strips 5 include a plurality of second pre-breaking portions 51 correspondingly connected to the soldering portion 23 of each of the terminals 2. A thickness of each of the second pre-breaking portions 51 is less than a thickness of the soldering portion 23. The second pre-breaking portions 51 are configured to bend and remove the second strip 5. After the base 21 is fixed to the strip connecting portion 3, each of the second strips 5 is bent and removed from the second pre-breaking portions 51, and the first strip 4 altogether with the terminals 2 and the strip connecting portions 3 are correspondingly inserted into the accommodating holes 11. When the base 21 and the strip connecting portion 3 are fixed inside the corresponding accommodating hole 11, the base 21 and the corresponding accommodating hole 11 form a contact of two points, and the strip connecting portion 3 and the corresponding accommodating hole 11 form a contact of two points. Then, each of the first strips 4 is bent and removed from the first pre-breaking portions 41. Each of the first strips 4 is located above the strip connecting portions 3, each of the second strips 5 is located below the soldering portion 23, and the second pre-breaking portions 51 is lower than the strip connecting portions 3. In the bending and removing process of the second strips 5, each of the second strips 5 is shaken in a left-right direction without being in contact with the strip connecting portions 3. Because each strip connecting portion 3 with a large strength is fixed to the corresponding terminal 2, and the strip connecting portion 3 provides a sufficient retaining force to the corresponding terminal 2, the bending and removing of the second strips 5 less affects the strip connecting portions 3 and the corresponding terminals 2. Each of the first pre-breaking portions 41 is higher than the base 21. That is, there is a gap between an upper end of the strip connecting portion 3 and the elastic arm 22. In the bending and removing process of the first strips 4, each of the first strips 4 is shaken in a left-right direction without being in contact with the corresponding terminal 2. Because the strength of the strip connecting portion 3 is large, the bending and removing of the first strips 4 less affects the strip connecting portions 3 and the corresponding terminals 2. When the chip module presses downward, the elastic arm 22 is elastically deformed and downward approaches the circuit board 1, and a projection of the elastic arm 22 is located between two adjacent accommodating holes 11 in the front row. When the chip module presses downward to a final position, the strip connecting portion 3 is lower than a highest position of the elastic arm 22, and the strip connecting portion 3 is not in contact with the chip module. That is, short-circuiting does not occur between the strip connecting portion 3 and the chip module.

Figure 8:
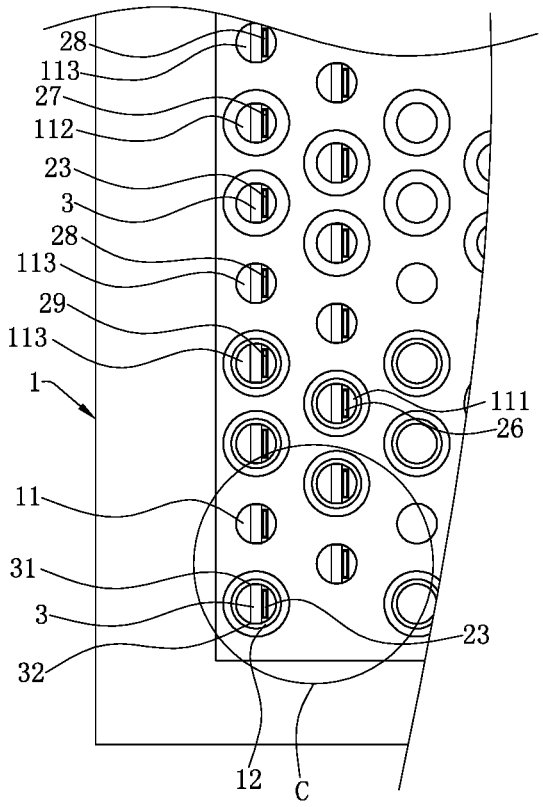
FIG. 8 is a partial top view of an electrical connector according to a second embodiment of the present invention.
Figure 9:
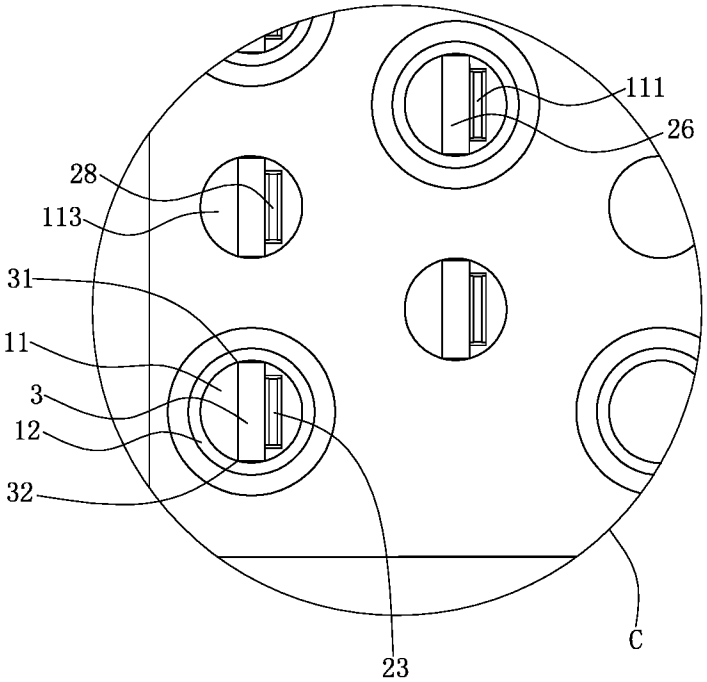
FIG. 9 is an enlarged view of a part C in FIG. 8.

FIG. 8 and FIG. 9 show a second embodiment of the present invention, which is different from the first embodiment in that: the virtual central line of each strip connecting portion 3 in the width direction and the virtual central line of the corresponding accommodating hole 11 are coincident. Each strip connecting portion 3 is located in the center of the corresponding accommodating hole 11, and the strip connecting portion 3 and the corresponding accommodating hole 11 are in an interference fit. The strip connecting portion 3 and the corresponding accommodating hole 11 form a contact of three points. The width of the strip connecting portion 3 is greater than the width of the base 21, and the strength of the strip connecting portion 3 is relatively large. Two contact points are symmetrical about the virtual central line of the corresponding accommodating hole 11. The strip connecting portion 3 bears the opposite abutting forces of the corresponding accommodating hole 11 and the base 21, and the base 21 is not in contact with the corresponding accommodating hole 11, such that the base 21 is not squeezed by the corresponding accommodating hole 11, and a structure between the strip connecting portion 3 and the base 21 is relatively stable. Other structures and functions in this embodiment are completely the same as those in the first embodiment, and are not further elaborated herein.

Figure 10:
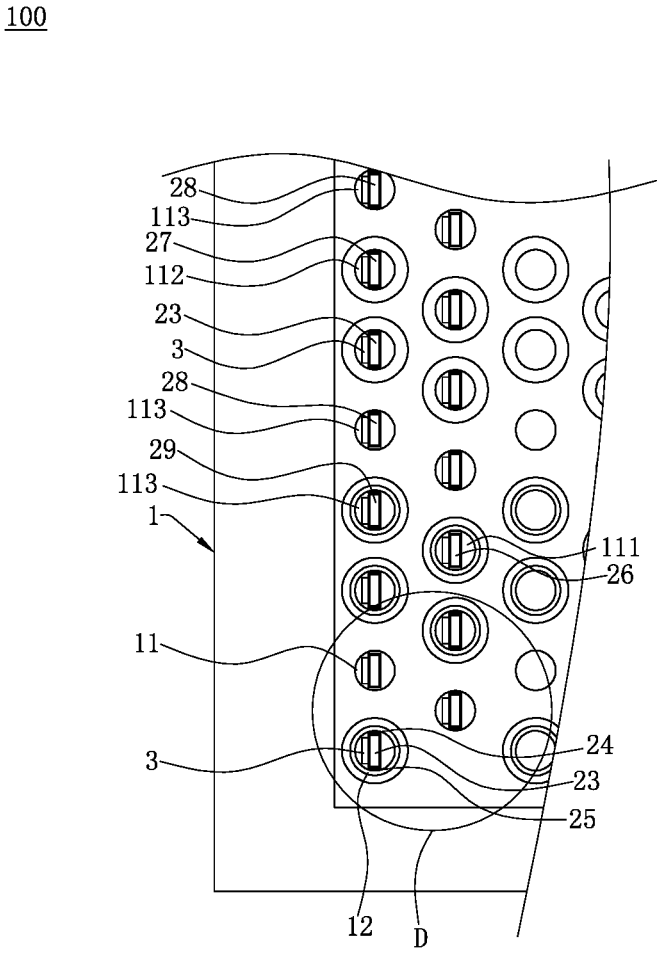
FIG. 10 is a partial top view of an electrical connector according to a third embodiment of the present invention.
Figure 11:
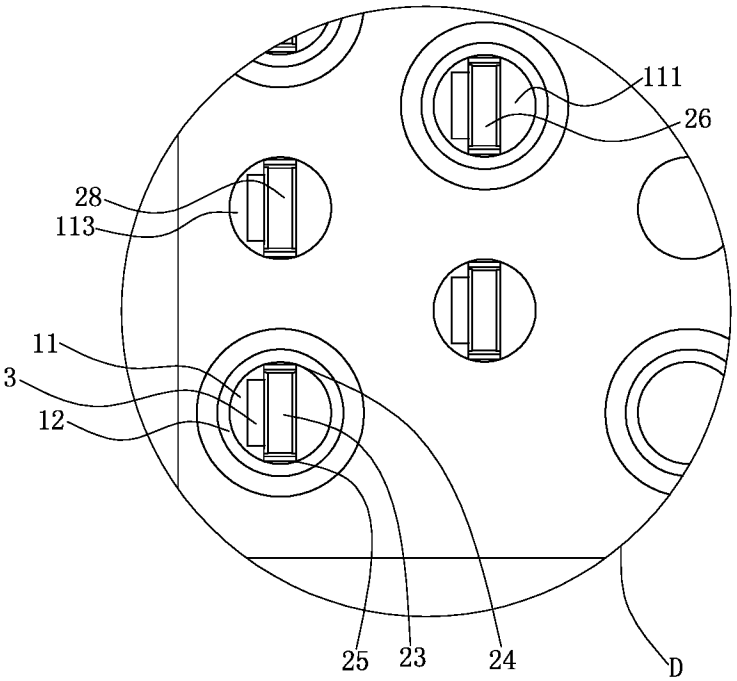
FIG. 11 is an enlarged view of a part D in FIG. 10.

FIG. 10 and FIG. 11 show a third embodiment of the present invention, which is different from the first embodiment in that: the virtual central line of the base 21 in the width direction and the virtual central line of the corresponding accommodating hole 11 are coincident. The base 21 is located in the center of the corresponding accommodating hole 11. The base 21 and the corresponding accommodating hole 11 are in an interference fit. The base 21 and the corresponding accommodating hole 11 form a contact of three points. The width of the base 21 is greater than the width of the strip connecting portion 3, and the strength of the base 21 is relatively larger. Two contact points are symmetrical about the virtual central line of the accommodating hole 11. The base 21 bears opposite abutting forces of the corresponding accommodating hole 11 and the strip connecting portion 3, and the strip connecting portion 3 is not in contact with the corresponding accommodating hole 11, such that the strip connecting portion 3 is not squeezed by the corresponding accommodating hole 11, and the structure between the strip connecting portion 3 and the base 21 is relatively stable. Other structures and functions in this embodiment are completely the same as those in the first embodiment, and are not further elaborated herein.

Figure 12:
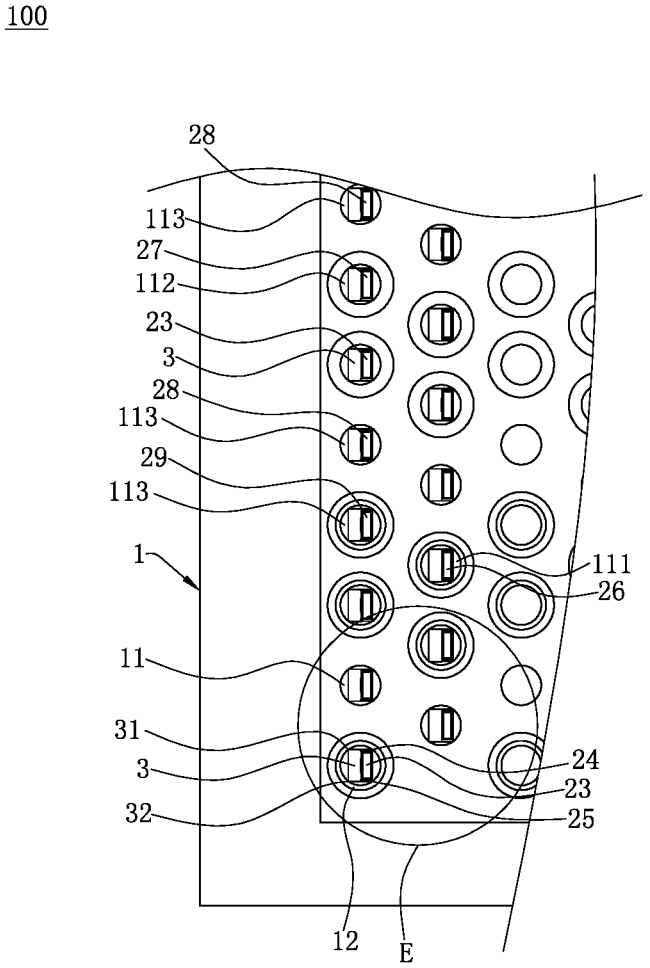
FIG. 12 is a partial top view of an electrical connector according to a fourth embodiment of the present invention.
Figure 13:
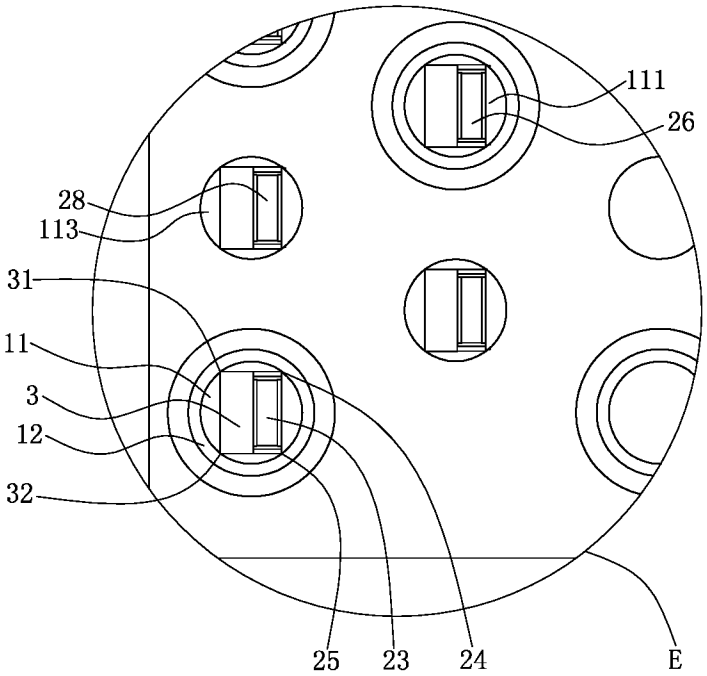
FIG. 13 is an enlarged view of a part E in FIG. 12.

FIG. 12 and FIG. 13 show a fourth embodiment of the present invention, which is different from the first embodiment in that: the strip connecting portion 3 and the corresponding accommodating hole 11 form a contact of two points, and the base 21 and the corresponding accommodating hole 11 form a contact of at least one point; or the strip connecting portion 3 and the corresponding accommodating hole 11 form a contact of one point, and the base 21 and the corresponding accommodating hole 11 form a contact of at least two points. Both the strip connecting portion 3 and the base 21 are respectively in interference fit with the corresponding accommodating hole 11. Both the strip connecting portion 3 and the base 21 bear the abutting forces of the corresponding accommodating hole 11, and the strip connecting portion 3 and the base 21 abut each other, such that forces acted on the strip connecting portion 3 and the base 21 in a horizontal direction are relatively balanced, and the structure between the strip connecting portion 3 and the base 21 is relatively stable. Other structures and functions in this embodiment are completely the same as those in the first embodiment, and are not further elaborated herein.

Figure 14:
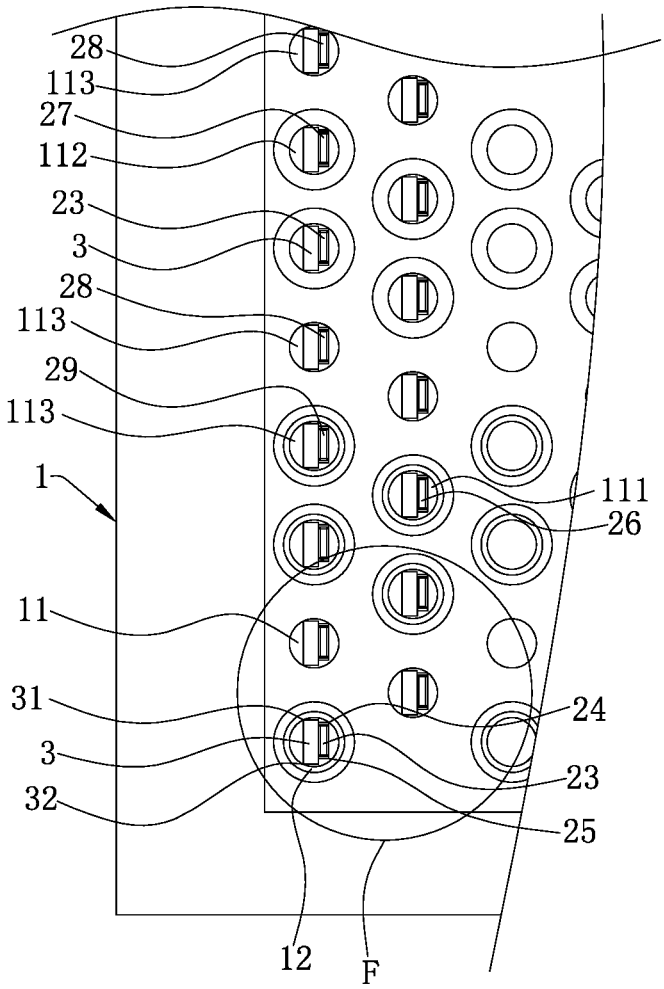
FIG. 14 is a partial top view of an electrical connector according to a fifth embodiment of the present invention.
Figure 15:
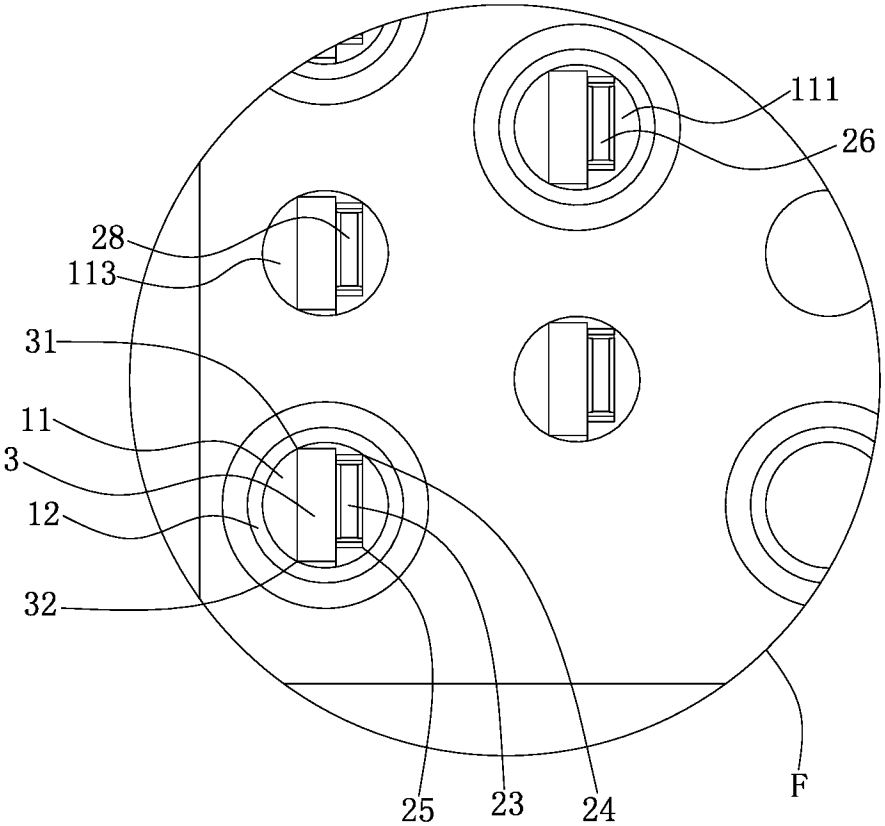
FIG. 15 is an enlarged view of a part F in FIG. 14.

FIG. 14 and FIG. 15 show a fifth embodiment of the present invention, which is different from the first embodiment in that: for each terminal 2, the first corner point 31 and the second corner point 32 of the strip connecting portion 3 are both in contact with the corresponding accommodating hole 11, and the third corner point 24 of the base 21 is in contact with the corresponding accommodating hole 11. In other words, the fourth corner point 25 of the base 21 is not in contact with the corresponding accommodating hole 11. Thus, the strip connecting portion 3 and the corresponding accommodating hole 11 form a contact of two points, and the base 21 and the corresponding accommodating hole 11 form a contact of one point. In other words, the strip connecting portion 3, the base 21 and the corresponding accommodating hole 11 form a contact of three points. Both the strip connecting portion 3 and the base 21 are respectively in interference fit with the corresponding accommodating hole 11. Both the strip connecting portion 3 and the base 21 bear the abutting forces of the corresponding accommodating hole 11, and the strip connecting portion 3 and the base 21 abut each other, such that forces acted on the strip connecting portion 3 and the base 21 in a horizontal direction are relatively balanced, and the structure between the strip connecting portion 3 and the base 21 is relatively stable. Other structures and functions in this embodiment are completely the same as those in the first embodiment, and are not further elaborated herein.

Figure 16:
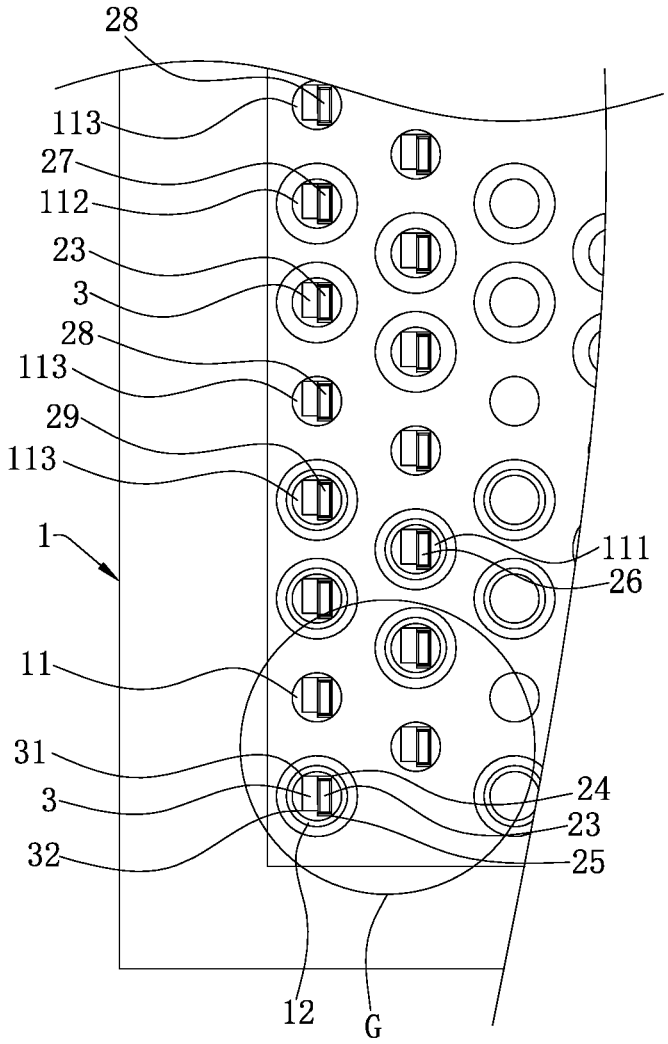
FIG. 16 is a partial top view of an electrical connector according to a sixth embodiment of the present invention.
Figure 17:
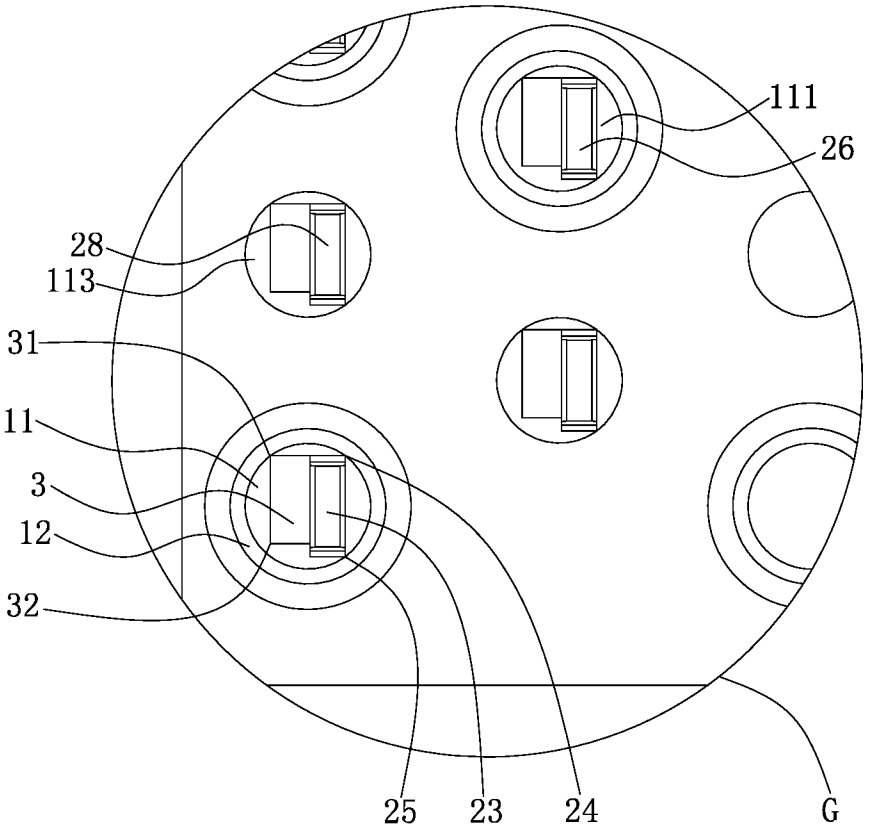
FIG. 17 is an enlarged view of a part Gin FIG. 16.

FIG. 16 and FIG. 17 show a sixth embodiment of the present invention, which is different from the first embodiment in that: for each terminal 2, the first corner point 31 of the strip connecting portion 3 is in contact with the corresponding accommodating hole 11, and the third corner point 24 and the fourth corner point 25 of the base 21 are in contact with the corresponding accommodating hole 11. In other words, the second corner point 32 of the strip connecting portion 3 is not in contact with the corresponding accommodating hole 11. Thus, the strip connecting portion 3 and the corresponding accommodating hole 11 form a contact of one point, and the base 21 and the corresponding accommodating hole 11 form a contact of two points. In other words, the strip connecting portion 3, the base 21 and the corresponding accommodating hole 11 form a contact of three points. Both the strip connecting portion 3 and the base 21 are respectively in interference fit with the corresponding accommodating hole 11. Both the strip connecting portion 3 and the base 21 bear the abutting forces of the corresponding accommodating hole 11, and the strip connecting portion 3 and the base 21 abut each other, such that forces acted on the strip connecting portion 3 and the base 21 in a horizontal direction are relatively balanced, and the structure between the strip connecting portion 3 and the base 21 is relatively stable. Other structures and functions in this embodiment are completely the same as those in the first embodiment, and are not further elaborated herein.

To sum up, the electrical connector 100 according to certain embodiments of the present invention has the following beneficial effects:

The strip connecting portion 3 and the base 21 are correspondingly fixed to each other and are jointly inserted into the corresponding accommodating hole 11. Each strip connecting portion 3, the corresponding base 21 and the corresponding accommodating hole 11 altogether form a contact of four points. The strip connecting portion 3 and the corresponding accommodating hole 11 form a contact of two points, and the base 21 and the corresponding accommodating hole 11 form another contact of two points. The width of the strip connecting portion 3 is greater than a width of the corresponding base 21, and the thickness of the strip connecting portion 3 is greater than a thickness of the corresponding base 21. When each strip connecting portion 3 and the corresponding terminal 2 are inserted into the corresponding accommodating hole 11, the strip connecting portion 3 supports and abuts the corresponding terminal 2, such that the corresponding terminal 2 is not easily deformed or rotated during the insertion, and the corresponding terminal 2 is not easily damaged, ensuring the corresponding terminal 2 to be stably fixed in the corresponding accommodating hole 11. When the chip module presses downward, a stable contact may be achieved between each terminal 2 and the chip module. In addition, a thickness of each terminal 2 remains unchanged when the foregoing performance is ensured, such that the terminals 2 are provided with fatigue-resistant.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

a circuit board, provided with a plurality of accommodating holes, wherein each of the accommodating holes is circular shaped;

a plurality of terminals, wherein each of the terminals comprises a base, and the base is accommodated in a corresponding one of the accommodating holes; and a plurality of strip connecting portions, wherein each of the strip connecting portions is configured to be connected upward to a corresponding one of a plurality of first strips, one of the strip connecting portions and the base of a corresponding one of the terminals are fixed to each other and are accommodated in the corresponding one of the accommodating holes, and the one of the strip connecting portions, the base of the corresponding one of the terminals and the corresponding one of the accommodating holes altogether form a contact of at least three points;

wherein each of the first strips comprises a plurality of first pre-breaking portions correspondingly connected to the strip connecting portions, the base is configured to be connected downward to a second strip, the second strip comprises a plurality of second pre-breaking portions correspondingly connected to the base of each of the terminals, and the first strips and the second strips are provided in parallel vertically, each of the first pre-breaking portions is correspondingly located higher than the base, and each of the second pre-breaking portion is correspondingly located lower than one of the strip connecting portions.

2. The electrical connector according to claim 1, wherein a virtual central line of the one of the strip connecting portions in a width direction and a virtual central line of the corresponding one of the accommodating holes are coincident, and the one of the strip connecting portions and the corresponding one of the accommodating holes form the contact of at least three points.

3. The electrical connector according to claim 1, wherein a width of each of the strip connecting portions is greater than a width of the base of each of the terminals, and a thickness of each of the strip connecting portions is greater than a thickness of the base of each of the terminals.

4. The electrical connector according to claim 1, wherein the terminals comprise a plurality of low frequency signal terminals, the accommodating holes comprise a plurality of first accommodating holes correspondingly accommodating the low frequency signal terminals, an inner wall of each of the first accommodating holes is provided with a conductive layer, and the conductive layer is electrically connected to a corresponding one of the low frequency signal terminals.

5. The electrical connector according to claim 4, wherein:

the terminals further comprise a plurality of high frequency signal terminals, the accommodating holes further comprise a plurality of second accommodating holes correspondingly accommodating the high frequency signal terminals, and an inner wall of each of the second accommodating holes is not provided with the conductive layer; and the terminals further comprise a plurality of ground terminals and a plurality of power terminals, the accommodating holes further comprise a plurality of third accommodating holes, each of the ground terminals and the power terminals is respectively accommodated in a corresponding one of the third accommodating holes, an inner wall of each of the third accommodating holes is provided with a conductive layer, the conductive layer of each of the third accommodating holes accommodating the ground terminals is electrically connected to a corresponding one of the ground terminals, and the conductive layer of each of the third accommodating holes accommodating the power terminals is electrically connected to a corresponding one of the power terminals.

6. The electrical connector according to claim 1, wherein a virtual central line of the base in a width direction and a virtual central line of the corresponding one of the accommodating holes are coincident, and the base and the corresponding one of the accommodating holes form the contact of at least three points.

7. The electrical connector according to claim 1, wherein:

the one of the strip connecting portions and the corresponding one of the accommodating holes form a contact of two points, and the base and the corresponding one of the accommodating holes form a contact of at least one point; or the one of the strip connecting portions and the corresponding one of the accommodating holes form a contact of one point, and the base and the corresponding one of the accommodating holes form a contact of at least two points.

8. The electrical connector according to claim 1, wherein the one of the strip connecting portions, the base of the corresponding one of the terminals and the corresponding one of the accommodating holes altogether form a contact of four points, the one of the strip connecting portions and the corresponding one of the accommodating holes form a contact of two points, the base and the corresponding one of the accommodating holes form a contact of two points, and a virtual central line of the base of the corresponding one of the terminals in a width direction and a virtual central line in a width direction of the one of the strip connecting portions are coincident.

9. The electrical connector according to claim 8, wherein each of the strip connecting portions comprises a first corner point and a second corner point, the first corner point and the second corner point both abut the corresponding one of the accommodating holes, the base comprises a third corner point and a fourth corner point, the third corner point and the fourth corner point both abut the corresponding one of the accommodating holes, and a distance between the first corner point and the second corner point is greater than a distance between the third corner point and the fourth corner point.

* * * * *